United States Patent [19]

Droho

[11] Patent Number: 5,072,156

[45] Date of Patent: Dec. 10, 1991

[54] BALLAST CIRCUIT MEANS TO DISCONNECT POWER FACTOR CAPACITOR

[75] Inventor: Joseph S. Droho, Chicago, Ill.

[73] Assignee: North American Philips Corporation, New York, N.Y.

[21] Appl. No.: 619,855

[22] Filed: Nov. 29, 1990

[51] Int. Cl.[5] ..... H05B 37/00

[52] U.S. Cl. ..... 315/232; 315/240; 315/247

[58] Field of Search ..... 315/232, 240, 247, 307, 315/312, 324, 325

[56] References Cited

U.S. PATENT DOCUMENTS

| | | | |
|---|---|---|---|
| 3,541,421 | 11/1970 | Buchman | 315/247 X |
| 3,780,347 | 12/1973 | Riesland | 315/247 X |
| 4,254,362 | 3/1981 | Tulleners | 315/247 X |
| 4,473,779 | 9/1984 | Lindner et al. | 315/247 X |
| 4,506,195 | 3/1985 | Elms | 315/247 X |

FOREIGN PATENT DOCUMENTS

| | | | |
|---|---|---|---|
| 2425720 | 4/1976 | Fed. Rep. of Germany . | |
| 0146479 | 11/1979 | Japan | 315/247 |
| 0898577 | 6/1962 | United Kingdom | 315/247 |
| 8912377 | 12/1989 | World Int. Prop. O. | 315/247 |

*Primary Examiner*—Robert J. Pascal

*Attorney, Agent, or Firm*—Robert T. Mayer

[57] ABSTRACT

An arrangement for use with gaseous discharge lamp circuits having power factor capacitors in which the capacitor is disconnected from the circuit when the lamp is not drawing current.

8 Claims, 1 Drawing Sheet

BALLAST CIRCUIT MEANS TO DISCONNECT POWER FACTOR CAPACITOR

This is an invention in the lighting art. More particularly, it involves an arrangement for use in gaseous discharge lamp circuits.

In certain gaseous discharge lamp circuits, particularly those using reactor ballasts with power factor correction, the power factor capacitor continues to draw current notwithstanding the lamp is no longer drawing current. Among other reasons why such a condition can occur is because the lamp is physically removed from the circuit or is burned out or is broken. Experience has shown that this lamp open circuit current is approximately twice the normal lamp operating current. This high lamp open circuit current limits the number of power factor corrected lamps which can be connected behind a fuse or a circuit breaker on a power line. Failure to properly limit the number of such lamps on such a power line could adversely affect the restoration of lighting on such a power line after a power outage.

It is an object of this invention to improve the operation of gaseous discharge lamp circuits with power factor correction.

One of the features of the invention is that it prevents open circuit current flow in power factor corrected gaseous discharge lamp circuits.

One of the advantages of the invention is that it permits about twice as many reactor ballast power factor corrected gaseous discharge lamps to be connected in a fused or circuit breakered line than could previously be so connected without the fear that such lamps will not relight after a power failure.

In carrying out the invention, there is provided a gaseous discharge lamp system including a source of voltage and a gaseous discharge lamp for connection to the source of voltage. A ballast means is connected in series with the gaseous discharge lamp and a power factor capacitor is connectable across the source of voltage. Also included is a sensing means which senses that current is flowing in the lamp when it is connected to the source of voltage. The sensing means connects the power factor capacitor across the source of voltage. The sensing means operates when no current is flowing in the lamp to disconnect the power factor capacitor from the source of voltage.

Figure 1:
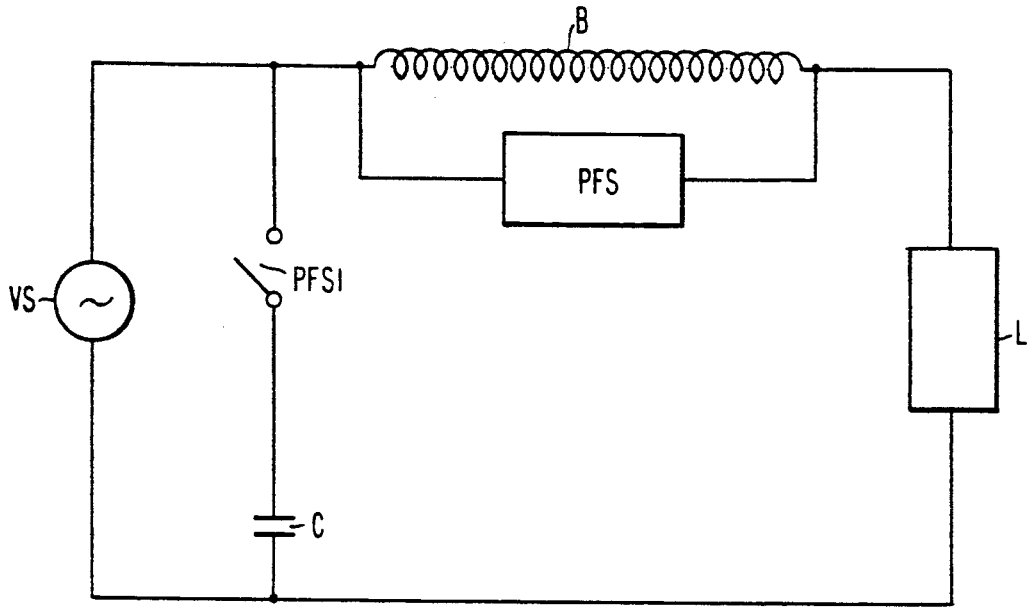
Figure 2:
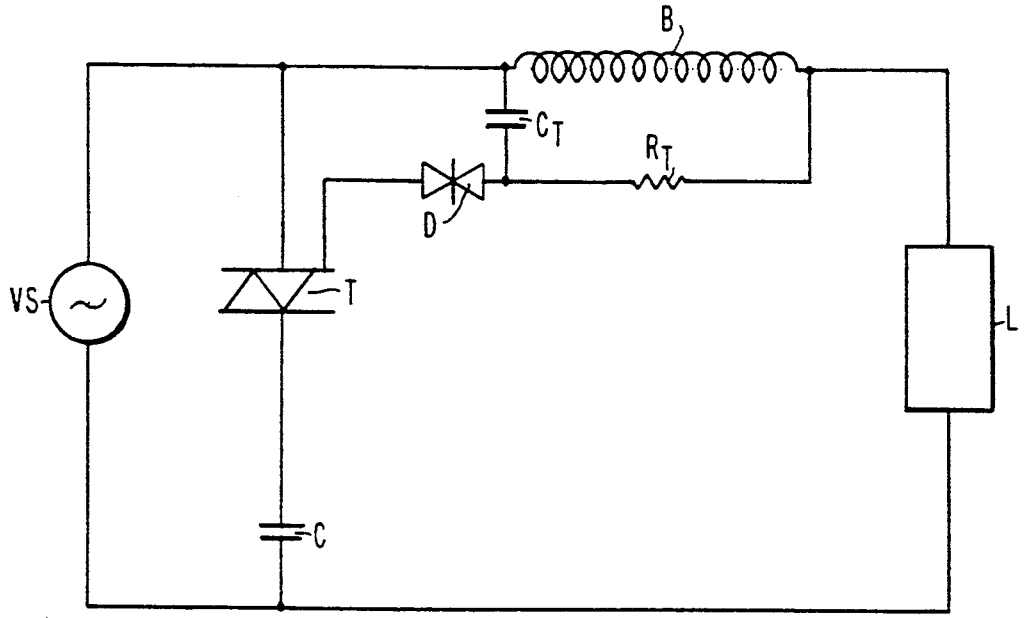

Other objects, features and advantages of the invention will be apparent from the following description and appended claims when considered in conjunction with the accompanying drawing in which:

FIG. 1 is a schematic wiring diagram of one embodiment of the invention, and FIG. 2 is a schematic wiring diagram of a second embodiment of the invention.

Referring to FIG. 1, there is shown therein a lamp L connected in series with a ballast means B in the form of a reactor ballast and a voltage source VS. Coil PFS of a power factor switch is connected in parallel with reactor ballast B. A normally open contact PFS1 of the power factor switch is connected in series with a power factor correction capacitor C. Both of these elements are connected across voltage source VS.

In operation should all elements shown in FIG. 1 be in circuit with each other, lamp L will light in response to the voltage across it and reactor ballast B from voltage source VS. With current flowing through lamp L a voltage drop is produced across reactor ballast B which is sensed by coil PFS of the power factor switch. Upon sensing such voltage, the power factor switch would close its contact PFS1 and connect power factor correcting capacitor C in the circuit to improve the power factor of the circuit.

If lamp L should cease to draw current from voltage source VS for whatever reason, the voltage drop across ballast means B will cease and the coil PFS of the power factor switch will no longer be energized. As a result, contact PFS1 of the power factor switch will open and remove power factor correcting capacitor C from the circuit so that it will no longer draw current from voltage source VS.

In the FIG. 2 embodiment, solid state devices have been substituted for the mechanical power factor switch of the FIG. 1 embodiment. When current flows through lamp L the voltage drop across reactor ballast B causes a voltage to appear at the junction of capacitor $C_T$ and resistor $R_T$ which is sufficient to cause triac D to conduct. This triggers diac T into conduction as well. When this occurs, the power factor correction capacitor C is connected in the circuit to improve the power factor thereof. Should lamp L cease to conduct the voltage at the junction between capacitor $C_T$ and resistor $R_T$ would cease and diac D would turn off. When this occurs, no signal is available to trigger triac T and consequently it ceases to conduct as well, removing power factor correcting capacitor C from the circuit.

It should be apparent that various modifications of the above will be evident to those skilled in the art and that what is disclosed herein is for illustrative purposes and is not to be considered restrictive.

What is claimed is:

1. A gaseous discharge lamp system including a source of voltage, a gaseous discharge lamp for connection to said source of voltage, a ballast means connected in series with said gaseous discharge lamp, a power factor capacitor for connection across said source of voltage and sensing means sensing that current is flowing in said lamp when connected to said source of voltage and connecting said power factor capacitor across said source of voltage in response thereto, said sensing means operating when no current is flowing in said lamp to disconnect said power factor capacitor from said source of voltage and wherein said sensing means includes a semiconductor switch means connected in series with said power factor capacitor, said semiconductor switch means being rendered conductive when current is flowing through said lamp, said semiconductor switch means including a capacitor and resistor connected in parallel with said ballast means, a diac with one terminal connected to the junction of said capacitor and said resistor and a triac connected in series with said power factor capacitor, the triggering electrode of said triac being connected to the other terminal of said diac.

2. A gaseous discharge lamp system as in claim 1, wherein said sensing means includes a switch with a coil connected in parallel with said ballast means and a normally open contact connected in series with said power factor capacitor.

3. A gaseous discharge lamp system as claimed in claim 1, wherein said sensing means includes a semiconductor switch connected in series with said power factor capacitor, said switch being rendered conductive when current is flowing through said lamp.

4. A gaseous discharge lamp system as claimed in claim 3, wherein said semiconductor switch means includes a capacitor and resistor connected in parallel with said ballast means, a diac with one terminal connected to the junction of said capacitor and said resistor and a triac connected in series with said power factor capacitor, the triggering electrode of said triac being connected to the other terminal of said diac.

5. A gaseous discharge lamp system according to claim 1, wherein said ballast means is a reactor ballast.

6. A gaseous discharge lamp system according to claim 5, wherein said sensing means includes a switch with a coil connected in parallel with said reactor ballast and a normally open contact connected in series with said power factor capacitor.

7. A gaseous discharge lamp system as claimed in claim 5, wherein said sensing means includes a semiconductor switch connected in series with said power factor capacitor, said switch being rendered conductive when current is flowing through said lamp.

8. A gaseous discharge lamp system as claimed in claim 7, wherein said semiconductor switch means includes a capacitor and resistor connected in parallel with said reactor ballast, a diac with one terminal connected to the junction of said capacitor and said resistor and a triac connected in series with said power factor capacitor, the triggering electrode of said triac being connected to the other terminal of said diac.

* * * * *